US005509521A

United States Patent [19]

Bolen

[11] Patent Number: 5,509,521

[45] Date of Patent: Apr. 23, 1996

[54] COIN MECHANISM FOR VENDING MACHINE FOR HANDLING MAGNETIC COINS

[75] Inventor: Richard K. Bolen, Champaign, Ill.

[73] Assignee: Northwestern Corporation, Morris, Ill.

[21] Appl. No.: 158,253

[22] Filed: Nov. 24, 1993

Related U.S. Application Data

[63] Continuation-in-part of Ser. No. 749,437, Aug. 23, 1991, Pat. No. 5,339,937.

[51] Int. Cl.[6] ..... G07F 11/44

[52] U.S. Cl. ..... 194/292; 194/325

[58] Field of Search ..... 194/320, 324, 194/325, 210, 255, 292

[56] References Cited

U.S. PATENT DOCUMENTS

| | | | |
|---|---|---|---|
| 629,334 | 7/1899 | Brewer | 194/255 |
| 1,452,721 | 4/1923 | Antoine | 194/255 X |
| 1,907,638 | 5/1933 | Wurzbach et al. | 194/326 |
| 2,091,232 | 8/1937 | Vogel et al. | 194/320 |
| 3,193,075 | 7/1965 | Okolischan et al. | 194/326 |
| 3,317,016 | 5/1967 | Turillon | 194/319 |
| 3,556,276 | 1/1971 | Pennell | 194/324 |
| 3,980,168 | 9/1976 | Knight et al. | 194/338 |
| 5,190,133 | 3/1993 | Bolen | 194/350 |

*Primary Examiner*—F. J. Bartuska

*Attorney, Agent, or Firm*—Willian Brinks Hofer Gilson & Lione

[57] ABSTRACT

An improved coin receiving mechanism for a vending machine, especially of the bulk vending machine type, and a method for operation thereof. The coin receiving mechanism accepts magnetic coins of a proper denomination and rejects other coins. The improved coin receiving mechanism includes a coin reception slot into which a coin of proper denomination can be received, a coin rejection slot aligned with respect to the coin reception slot so that a coin received in the coin reception slot is expelled from the coin receiving mechanism through the coin rejection slot, and a magnet mounted adjacent to the coin reception slot and adapted to apply a magnetic field to retain a magnetic coin in the coin receiving mechanism so that the magnetic coin can be directed into a coin storage area.

18 Claims, 5 Drawing Sheets

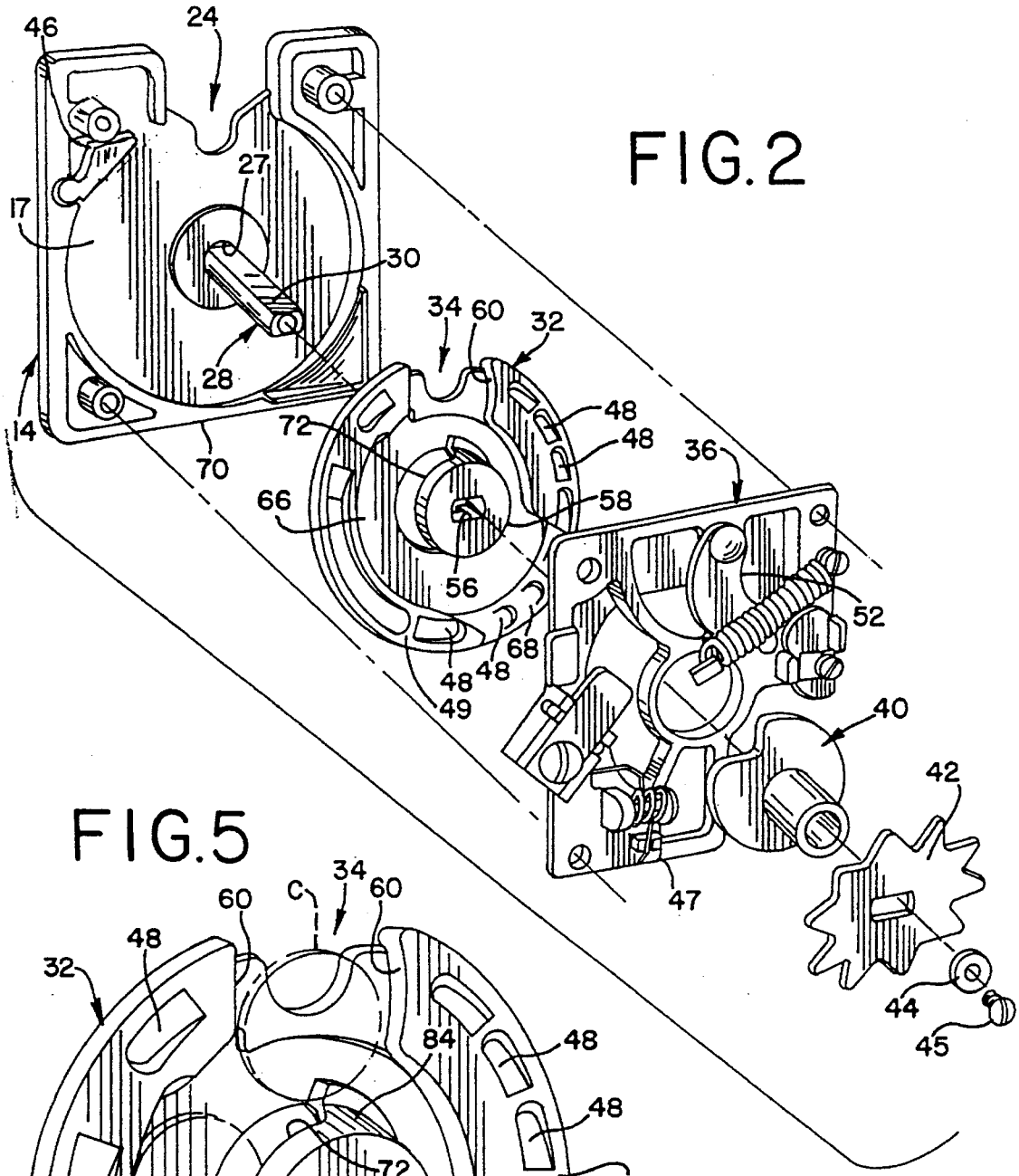
FIG. 2
FIG. 5
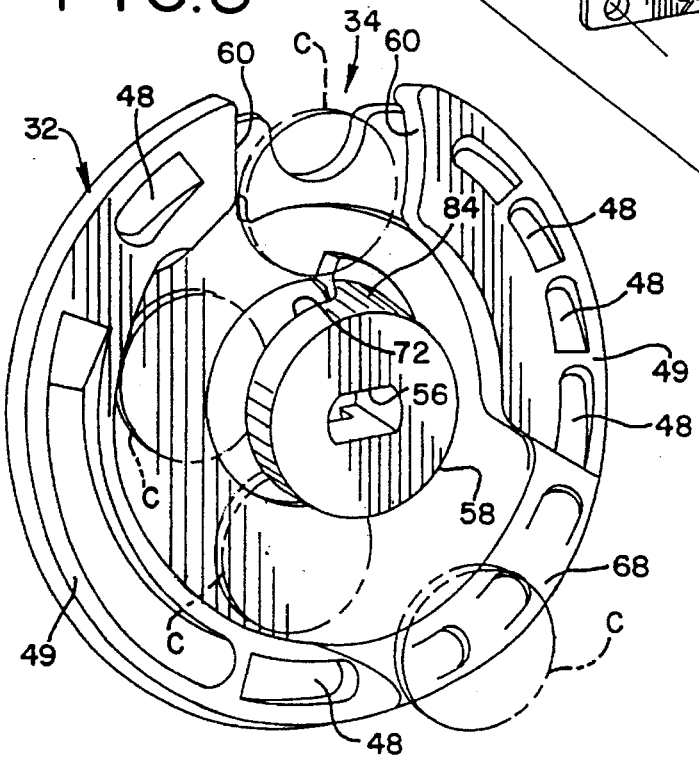

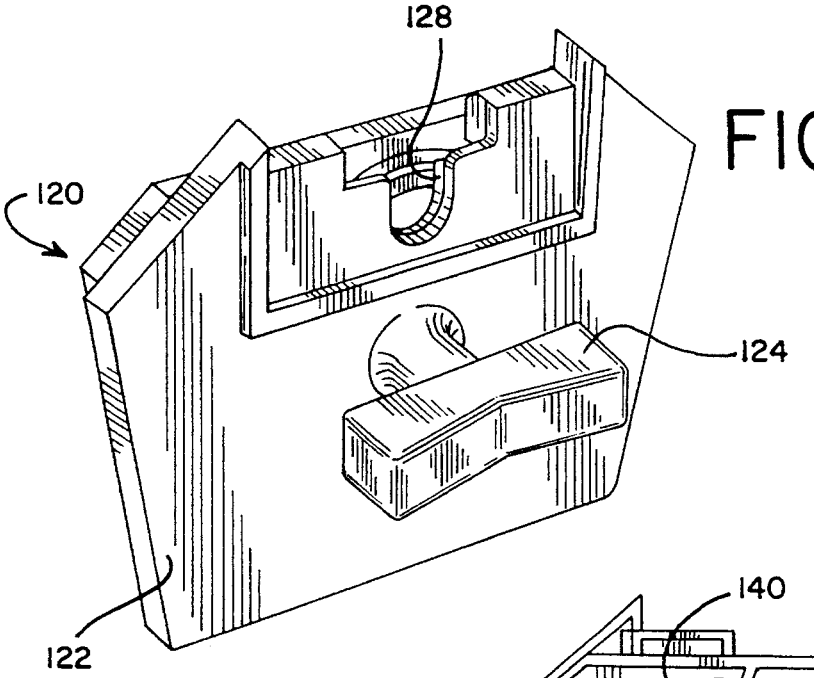
FIG. 10
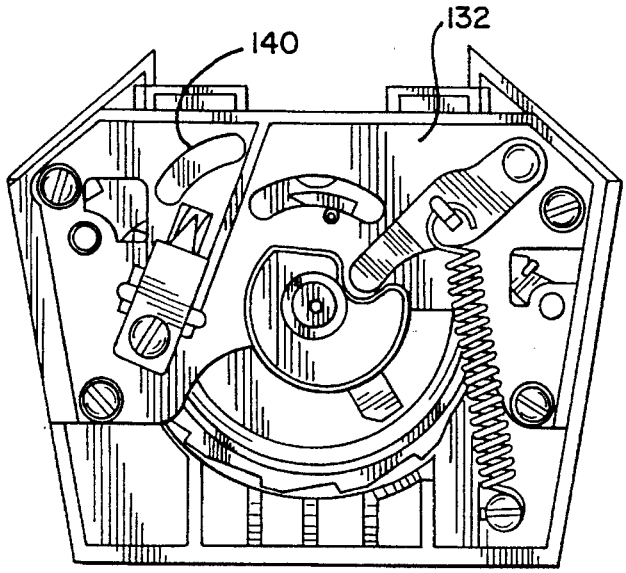
FIG. 11
FIG. 12
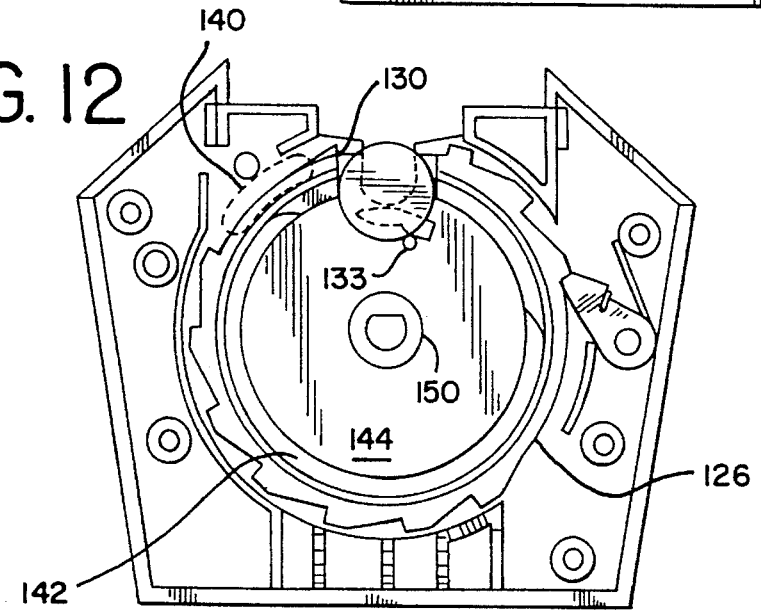

COIN MECHANISM FOR VENDING MACHINE FOR HANDLING MAGNETIC COINS

REFERENCE TO RELATED APPLICATION

This application is a continuation in part of Ser. No. 07/749,437 filed Aug. 23, 1991 now U.S. Pat. No. 5,339,937 the entire disclosure of which is incorporated herein by reference.

BACKGROUND OF THE INVENTION

The present invention relates to an improved coin receiving mechanism for a vending machine and a method for operation thereof and more particularly to an improved coin receiving mechanism for a bulk vending machine for handling magnetic coins, such as the Mexican peso.

Bulk vending machines can be found in the entrance ways or lobbies of supermarkets, department stores, hardware stores, gas stations and restaurants in the United States and many foreign countries. Bulk vending machines dispense candy, nuts, gum, or other confections or toys upon the payment of an appropriate coin or coins.

A bulk vending machine typically includes a storage bin or bins for holding the confections (i.e. the bulk merchandise items), a coin receiving mechanism for receiving a coin of the proper denomination, and a bulk dispensing mechanism for dispensing a quantity of the bulk items upon the payment of a coin of the proper denomination and the actuation of the coin receiving mechanism. The coin receiving mechanism typically includes a handle to be manually rotated, a face plate, and a rearward facing gear that engages a corresponding gear of the merchandise dispensing mechanism. The coin receiving mechanism may also include a coin wheel located directly behind a face plate and connected to a rearwardly extending stem or shaft connected to the handle. The coin wheel includes a coin receiving slot sized and adapted to receive a coin of the proper denomination.

Two examples of bulk vending machines are the standard Northwestern Model 60 (M60®) and the Triple Play® which is disclosed in U.S. Pat. No. 5,190,133 issued Mar. 2, 1993, the entire disclosure of which is incorporated herein by reference.

The coin receiving mechanism of a bulk vending machine typically incorporates features that distinguish between a coin of the proper denomination and coins of other than the proper denomination or slugs. Because bulk vending machines may be unattended, stand-alone devices and are usually not connected electrically to a power source, the coin receiving mechanism in a bulk vending machine should reliably distinguish coins of the proper denomination from coins of other than the proper denomination without relying on the provision of an external power source. Conventionally, a coin receiving mechanism uses the dimensions of the coin as a basis for acceptance or rejection. For example, a conventional coin receiving mechanism may include a receiving slot that is sized to prevent too large or wide a coin from entering. It is particularly desirable if the wrong coin can be readily expelled from the bulk vending machine without jamming the machine. Accordingly, some bulk vending machines are designed so that coins that are too small drop through the mechanism and do not allow actuation of the merchandise dispensing mechanism. The invention disclosed in Ser. No. 07/749,437 shows an improvement for a coin receiving mechanism for a bulk vending machine providing such a feature.

Although prior coin receiving mechanisms operate to distinguish between coins of different denominations when these coins are different sizes, if two coins of different denominations are very close in size, prior coin receiving mechanisms might not be able to reliably distinguish between them. Accordingly, it would be desirable in a coin receiving mechanism for a vending machine to provide a way for reliably distinguishing between similar sized coins of different denominations. Further, it would be desirable to provide a means to distinguish between such coins in a coin receiving mechanism that is relatively inexpensive to manufacture and maintain. In addition, since the overall cost of the bulk vending machine is an important factor, the coin receiving mechanism should be relatively inexpensive to manufacture and maintain.

SUMMARY OF THE INVENTION

To meet these and other objectives, the present invention provides an improved coin receiving mechanism for a bulk vending machine and a method for operation thereof. According to a first aspect of the present invention, an improved coin receiving mechanism provides for accepting magnetic coins of a proper denomination and rejecting other coins. The improved coin receiving mechanism includes a coin reception slot into which a coin of proper denomination can be received, a coin rejection slot aligned with respect to the coin reception slot so that a coin received in the coin reception slot is expelled from the coin receiving mechanism through the coin rejection slot, and a magnet mounted adjacent to the coin reception slot and adapted to apply a magnetic field to retain a magnetic coin in the coin receiving mechanism so that the magnetic coin can be directed into a coin storage area.

According to a further aspect of the present invention, there is provided an improved bulk vending machine having a coin receiving mechanism actuated by a rotation of a handle. The coin receiving mechanism is sized to receive therein a coin of the proper denomination. A magnet is associated with the coin receiving mechanism to test the received coin for the proper magnetic properties. If the coin is magnetic, the coin is accepted and if the coin is non-magnetic, the coin is expelled.

BRIEF DESCRIPTION OF THE FIGURES

FIG. 2 is a perspective exploded rear view of an embodiment of the coin receiving mechanism which is shown installed in the bulk vending machine of FIG. 1.

FIG. 5 is a perspective view of the embodiment of the coin wheel of FIGS. 2, 3 and 4 depicting the path of expelling of a disk other than the coin of the proper denomination.

Figure 7:
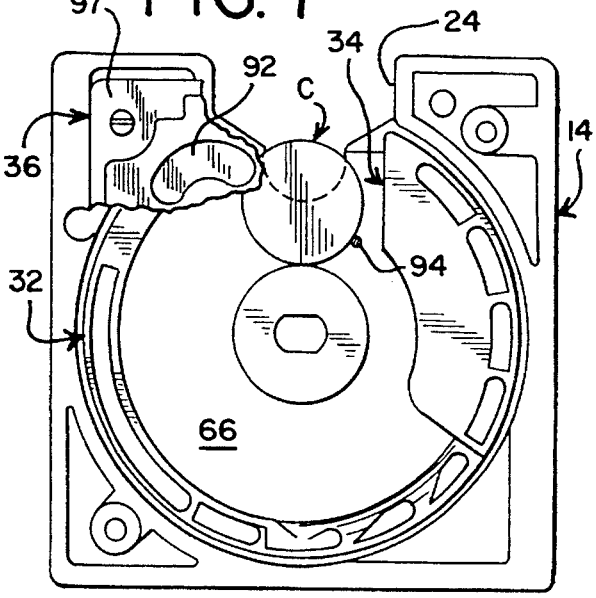
FIG. 7 is a rear view of the coin wheel mounted in the face plate with the frame shown in cutaway and including a coin retained therein.

FIGS. *9a–9b* show views similar to FIGS. 7 and illustrating the path of travel of a non-magnetic coin.

FIG. 10 is a perspective view of another coin receiving mechanism of another embodiment of the present invention.

FIG. 11 is a rear view of the coin receiving mechanism of FIG. 10.

FIG. 12 is a rear view of the face plate and coin wheel of the embodiment shown in FIGS. 10 and 11.

DETAILED DESCRIPTION OF A PREFERRED EMBODIMENT

The embodiments of the coin receiving mechanisms discussed below are for accepting magnetic coins such as the Mexican peso. It is noted that the U.S. nickel has approximately the same dimensions as the Mexican peso. The U.S. nickel however, has considerably less value. Therefore, the embodiments described below are specifically directed to coin receiving mechanisms for accepting the Mexican peso and rejecting the U.S. nickel.

Figure 1:
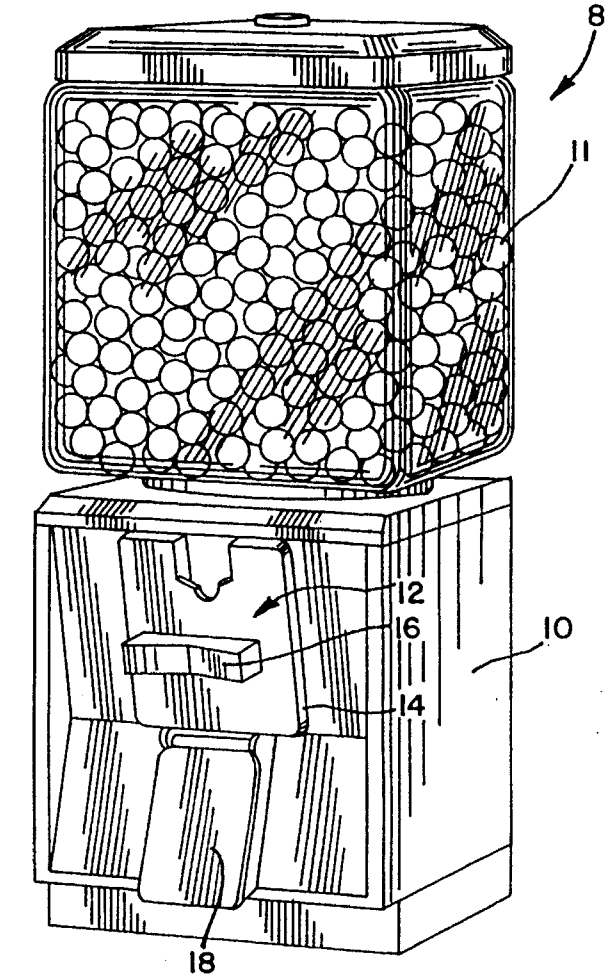
FIG. 1 is a perspective view of a bulk vending machine incorporating an embodiment of the present invention.

Referring to FIG. 1, there is shown a bulk vending machine 8. In this embodiment, the bulk vending machine 8 is a standard M60® bulk vending machine made by the Northwestern Corp. of Morris, Ill. The bulk vending machine 8 includes a base unit 10 and a product holder 11. The base unit 10 may be a generally rectangular metal housing. The product holder 11 may be made of a molded high strength clear plastic. The present embodiment may be incorporated in bulk vending machines other than the M60®, such as the Triple Play®, also made by the Northwestern Corp., or other bulk vending machines or vending machines of other types. The bulk vending machine 8 may be mounted on, or include, a stand (not shown) typically having a heavy base portion and a post extending from the base portion to engage the base unit 10.

The bulk vending machine 8 includes a coin receiving mechanism or portion 12. The coin receiving mechanism 12 is mounted in a forwardly oriented opening in the base unit 10. The coin receiving mechanism 12 includes a front or face plate 14 and a handle 16. The coin receiving mechanism 12 actuates a product dispensing portion (not shown) located inside of the base unit 10 upon the payment of a coin of the proper denomination into the coin receiving mechanism 12 and the operation of the handle 16 in a manner that is well known in the art. Dispensing of the product by the product dispensing portion is via a chute 18 located adjacent to the coin receiving mechanism 12 also located on the base unit 10.

Referring to FIG. 2, the coin receiving mechanism 12 includes the front or face plate 14. The face plate 14 has a rear side 17. The face plate 14 mounts into an opening in the base unit 10, thereby mounting the coin receiving mechanism 12 into the base unit 10. The face plate 14 may be generally rectangular in shape and includes a slot 24 located on an upper side for receiving a coin. In the M60 and the Triple Play bulk vending machines, the face plate 14 is approximately 3 ⅜ inches wide and 3½ inches high.

Extending through a centrally located opening 27 in the face plate 14 is a handle stem 28. The opening in the face plate 14 for receiving the handle stem 28 is sized and adapted to allow the handle stem 28 to rotate with respect to the face plate 14. The handle stem 28 is connected to the handle 16. The handle stem 28 preferably has a keyed shape, e.g. flattened sides 30.

Mounted on the handle stem 28 and engaging the keyed sides 30 thereof is a coin wheel 32. The coin wheel 32 is a planar disk shaped member having front and rear sides. The coin wheel 32 has located therein a first slot 34 located along the perimeter for receiving a coin of a proper denomination. The coin wheel 32 is mounted between the face plate 14 and a rear frame 36. Also mounted on the handle stem 28 are a cam 40 and a gear 42. A washer 44 and a mounting screw 45 connect to the stem 28 to maintain the coin wheel 32, cam 40, and gear 42 mounted thereon. The gear 42 engages the product dispensing portion (not shown) as mentioned above. On the inner side 17 of the face plate 14, there is a movably attached stop 46 to prevent clockwise movement of the coin wheel 32 unless a proper size coin is located in the first coin slot 34. The rear frame 36 has mounted thereon a spring loaded pawl 47 which abuts up against and engages a wall formed in notches 48 located in a perimeter area 49 of the coin wheel 32 to prevent rotation of the coin wheel 32 in other than its proper direction, e.g. counter-clockwise. In addition, to prevent coins of the improper denomination from being accepted and operating the bulk vending machine, pawls may be used to prevent washers and coins smaller than the required coin from operating the mechanism. Also attached to the back plate 36 is a return lever 52 which abuts against the cam 40 which is attached to the stem 28. Working together, the cam 40 and return lever 52 return the handle 16 to the starting position when it is turned.

In a preferred embodiment, the coin wheel 32 is made of cast aluminum and has a diameter of approximately 2⅞ inches. The coin wheel 32 includes a keyed opening 56 formed in its center for receiving and engaging the handle stem 28.

The bulk vending machine handle and its connection to the coin wheel in particular should be of a sturdy construction because of the high level of usage to which these pieces are subjected. If the handle is jammed or otherwise disabled, the bulk vending machine will not function properly. Also, the handle is potentially subject to vandals who might try to jam the handle in a dispensing position. One way to make a bulk vending machine resistant to vandalism and pilferage is to provide a reinforced collar around the connection of the handle stem or shaft to the coin wheel. Accordingly, the coin wheel 32 also includes a raised cylindrical portion or hub 58 located around the opening 56. The raised cylindrical portion 58 provides for reinforcing the connection of the handle stem 28 to the coin wheel and thereby to the coin receiving portion 12 and to the rest of the bulk vending machine 8 to make it more durable and resistant to vandalism or pilferage. In a preferred embodiment, the raised cylindrical portion 58 has a diameter of approximately ⅞ inches. In a preferred embodiment, the perimeter area 49 containing the slots 48 occupies an area of approximately ¼ inches along the perimeter of the coin wheel 32.

Figure 3:
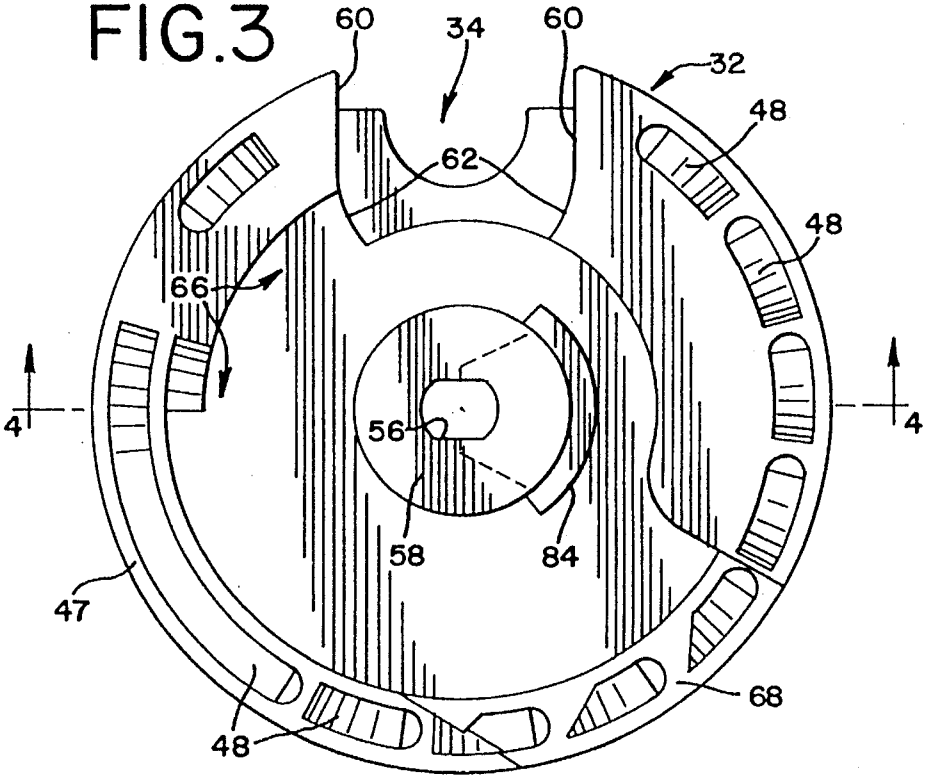
FIG. 3 is a rear view of an embodiment of a coin wheel shown in FIG. 2.
Figure 4:
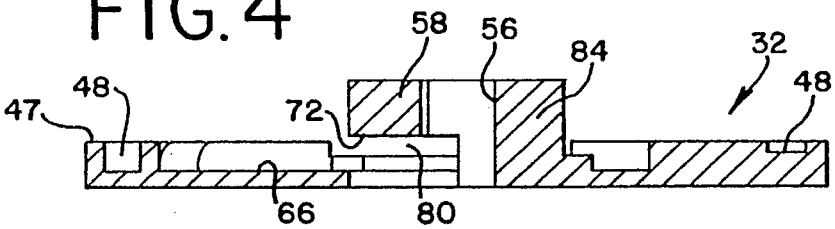
FIG. 4 is a cross sectional view taken along 4—4' of FIG. 3.

As shown in FIGS. 3 and 4, the coin wheel 32 has the first slot 34 located in a portion thereof to receive a coin of a proper denomination. The first slot 34 is located on the rear side of the coin wheel 32 and open to the perimeter to receive a coin therefrom. The first slot 34 includes side walls 60 sized and adapted to conform to the dimensions of a coin of a proper denomination. In the present embodiment, the coin of proper denomination is a Mexican peso, so accordingly, the walls 60 are spaced approximately 13/16 inches apart. The walls 60 curve toward each other in lower portions 62 thereof to retain the coin of the proper denomination in position in the first slot of the coin wheel 32.

As mentioned above, it is desirable to be able to reject and expel coins of other than the proper denomination or other objects, e.g. slugs, that may be inserted into the coin receiving portion 32. Coins or other objects larger than the coin of the proper denomination, will not fit in the first slot 34 defined by the walls 60 of the coin wheel 32. It is also advantageous to expel coins or other objects smaller than the coin of the proper denomination that could be fitted into the first slot 34 formed by the walls 60. Some bulk vending machines have a coin dispensing mechanism with a large size face plate so that adequate room may be provided behind the large face plate and around a reinforced raised central hub to provide a passageway for expelling coins or other objects of other than the proper denomination around the hub and out a slot open to a lower edge of the coin receiving portion. However, in a bulk vending machine, such as the M60 or Triple Play, that has a coin receiving portion face plate that is relatively small, e.g. approximately 3½ inches across, there is insufficient room around the reinforced central hub to provide this feature. Considering specifically the coin receiving mechanism used in the M60 and Triple Play, once sufficient space is allocated on the coin wheel 32 (diameter 2⅞ inches) for the raised cylindrical portion 58 (diameter ⅞ inches) and the slotted perimeter 49 (¼ inch times 2=½ inch), there is only about ⅝ inch available on the coin wheel between the inner diameter of the slotted perimeter 49 and the outer diameter of the raised cylindrical portion 58. Although ⅝ inches would be adequate to provide for passage of some common U.S. coins, e.g. pennies, dimes, a slot of ⅝ inches would not be wide enough to pass a U.S. nickel which has a diameter of approximately 13/16 inches.

In this type of coin receiving mechanism, a drop through feature is provided by means of an improved coin wheel construction disclosed in Ser. No. 07/749,437 now U.S. Pat. No. 5,339,937. In the coin wheel 32, a coin slot or path (or second slot) 66 is formed in the rear side of the coin wheel 32. The coin slot or path 66 is located on the coin wheel rear side along and radially inward of the perimeter area 49. The coin slot 66 extends from the first coin slot 34 to an area 68 of the coin wheel. The area 68 is opposite from the first coin slot 34 and would correspond to a lower portion of the coin wheel when the coin wheel is in place in the bulk vending machine and in an "at rest" or initial position with the slot 34 oriented upward. At the area 68, the coin path 66 passes through or across the raised perimeter area 49. A lower edge 70 of the face plate 14 is sized and adapted to be spaced from the housing unit 10 to provide room for coins that travel in the path 66 to fall out the bottom of coin receiving portion 12 at the bottom of the face plate 14.

In order to provide a dimension sufficient to accommodate coins of the size of a U.S. nickel, the slot is approximately ⅞ inches wide. Therefore, if a coin, such as a U.S. nickel which is approximately 13/16 inches wide, is inserted into the first slot 34, it will fall through the second coin slot 66 and out the bottom of the coin receiving portion 12. In order to provide the second slot 66 with a width dimension of ⅞ inch, the second slot or path 66 passes through a portion of the raised cylindrical hub 58. In passing through the hub 58, the second slot 66 forms a third (or hub) slot 72 extending laterally into a side of the hub 58.

The coin wheel is preferably formed by a casting process. Referring to FIG. 4, in order to provide the slotted area 72 through the hub 58, a cavity 80 is formed from the other side (i.e. the front side of the coin wheel) through the plane of the coin wheel 32 and part of the way into the hub 58. Thus, the hub 58 is connected to the rest of the coin wheel 32 by a portion 84. With the construction of the coin wheel 32 illustrated in FIGS. 2–5, there is provided a reinforced hub 58 that is secure and resistant to wear and damage. Also with the construction illustrated in FIGS. 2-5, there is provided a coin path 66 that allows for coins other than the proper coin to fall through, and thereby be expelled. Further, these features are provided in a coin wheel 32 that fits in a coin receiving mechanism 12 that can be used in the M60 and the Triple Play and other bulk vending machines.

FIG. 5 shows the path of a coin such as a U.S. nickel as it passes along the second coin path 66 of the coin wheel 32.

Figure 6:
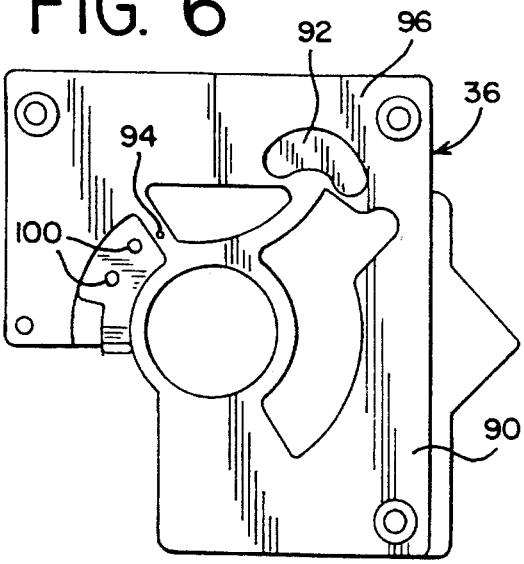
FIG. 6 is a front view of the frame shown in FIG. 2.

Referring to FIG. 6, there is shown a view of a front side 90 of the frame 36. The frame 36 is similar to the frames used in previous versions of similar bulk vending machines except that a magnet 92 is mounted in the frame 36 and a coin retainer pin 94 is mounted in the front side 90 of the frame 36.

In this preferred embodiment of the bulk vending machine, the magnet 92 is mounted in an upper right corner 96 of the frame 36 (when viewed from the front side as depicted in FIG. 6) so that the magnet 92 exerts an attractive magnetic force on an area of the coin wheel immediately clockwise from top center. The magnet 92 may be directly mounted into the frame 36 or may be mounted into a separate mounting retainer such as a brass mounting retainer which is then in turn mounted into the frame 36. The magnet 92 is located approximately ⅝ inches from the top edge and ¾ inches from the right edge of the frame 36. The magnet 92 should preferably be a permanent magnet. It is preferred to use a magnet of relatively high magnetic field strength. One example of a suitable magnet is a standard cobalt magnet with a pull poundage of approximately 0.75.

As mentioned above, another difference between this embodiment and previous versions of the coin receiving mechanism of the bulk vending machine is that a coin retainer pin 94 is located on the frame 36 approximately 1 1/16 inches from a top edge of the frame 14 and 1 1/16 inches from the left edge of the frame 14. The coin retainer pin 94 serves to maintain a suitably sized coin received in the slot 34 from falling into the coin path 66 until the coin wheel 32 is moved clockwise away from its initial position. The retaining pin 94 extends approximately 3/32 inches in a forward direction from the front side 90 of the frame 36.

It is noted that the magnet 92 is mounted in the frame 36 is a position such that it exerts a magnetic attractive force on the stop 46 (shown in FIG. 2). This force attracts the stop 46 in a downward direction. In prior coin receiving mechanisms, a spring was used to bias the stop 46 downward to prevent clockwise movement of the coin wheel 32 unless a proper size coin was located in the coin slot 34. However, since the magnet 92 serves to attract stop 46 in a downward direction, the need for a separate spring to downwardwardly bias the stop 46 is eliminated.

Referring to FIG. 7, there is illustrated the coin wheel 32 mounted in the face plate 14. A fragmentary portion 97 of the rear side of the frame 36 is shown in FIG. 7. The portion of the frame 36 shown in FIG. 7 has the magnet 92 mounted therein. The coin wheel 32 is shown in its initial rotational position. In this position, the coin wheel slot 34 is oriented vertically upward and is aligned with the corresponding slot 24 in the face plate 14. In the initial position, the coin wheel 32 can receive a coin C into the coin slot 34.

Also shown in FIG. 7 is the retaining pin 94. It should be understood that the retaining pin 94 is mounted on the non-rotating frame 36 and not on the rotatable coin wheel 32. When the coin wheel 32 is in its initial position, the retaining pin 98, because of its location on the frame 36, will retain a coin partially in the slot 34 and will prevent the coin from proceeding down the coin path 66 of the coin wheel 32. The retaining pin 94 may be formed or cast of the same material as the frame 36 (aluminum) or may be installed as a separate piece. In addition, the location of the pin 94 helps determine the size of the coin that can be retained in the initial position in the coin receiving mechanism. Accordingly, the mounting location of the retaining pin 94 on the frame 36 will be different when the coin receiving mechanism is used for coins of different sizes (denominations). Accordingly, it may be preferably to provide a series of drilled openings 100, as shown in FIG. 6, in predetermined locations corresponding to the locations at which the retaining pin should be located for coins of specific known sizes. In the embodiment shown in FIG. 7, the retaining pin 98 is located in a position to retain a Mexican peso in the coin slot 34.

Figure 7A:
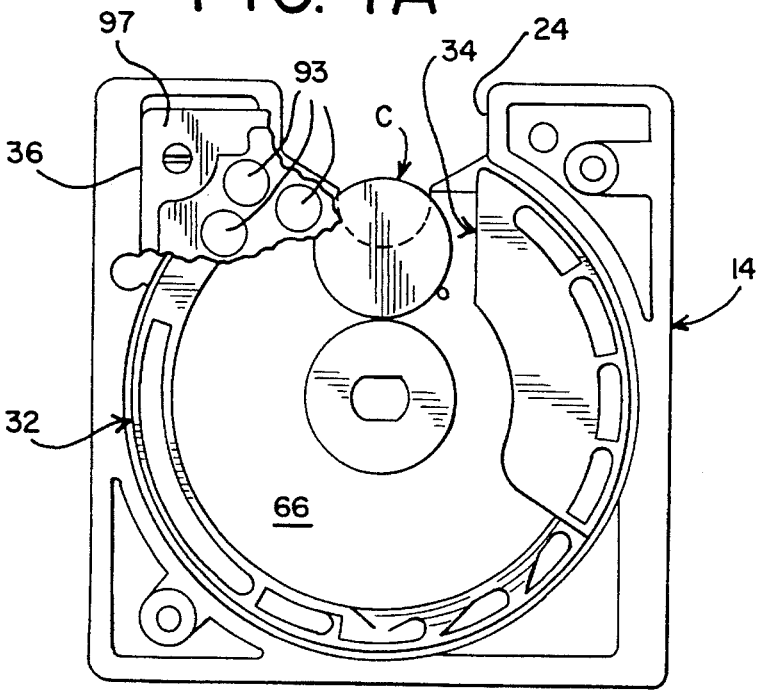
FIG. 7*a* is a view similar to that of FIG. 7 showing an alternative embodiment of the magnet mounted in the frame.

Referring to FIG. 7*a*, there is depicted an alternative embodiment. In the embodiment of FIG. 7*a*, instead of a single, kidney-shaped magnet as shown in FIG. 7, a plurality of smaller magnets 93 are mounted in the frame 36 in approximately the same location as the magnet 92 of FIG. 7. The plurality of smaller magnets 93 may be circular in shape and are mounted in corresponding circular openings in the frame 36. In all other respects, the embodiment of FIG. 7 would be similar to that of FIG. 7. In the embodiment shown in FIG. 7*a*, each of the three magnets has diameter of approximately 0.250 inches and a thickness of 0.10 inches.

Figure 8A:
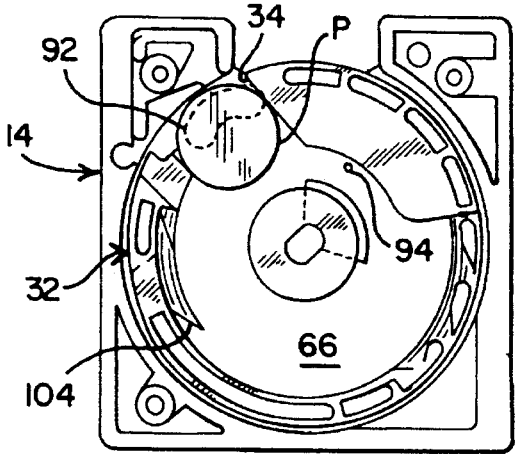
FIGS. 8*a*–8*d* show views similar to FIG. 7 with the coin wheel in several rotational positions of operation.

FIGS. 8*a*–8*d* are similar to FIG. 7 and show the face plate 14 and the coin wheel 32 with the coin wheel shown in several different rotational positions. The fragmentary portion of the frame 36 is not shown but the adjacent location of the magnet 92 mounted in the frame is shown by dashed lines. In FIGS. 8*a*–8*d*, the coin P is a proper denomination magnetic coin such as a Mexican peso. In FIG. 8*a*, the coin wheel 32 is shown to have been rotated approximately 45 degrees clockwise (when viewed from the front). In this position, the coin P has moved away from the retaining pin 94 and no longer is supported it. However, the magnet 92 (shown by the dashed line) is located on the frame directly adjacent and slightly above and to the right of the coin P when the coin wheel 32 is in this rotational position. The magnetic attractive force from the magnet 92 holds the coin P in the slot 34 of the coin wheel as it moves across this portion of its rotational path.

Figure 8B:
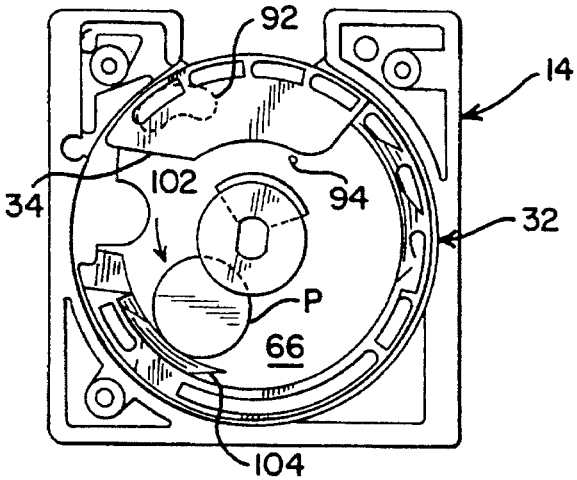
Figure 8C:
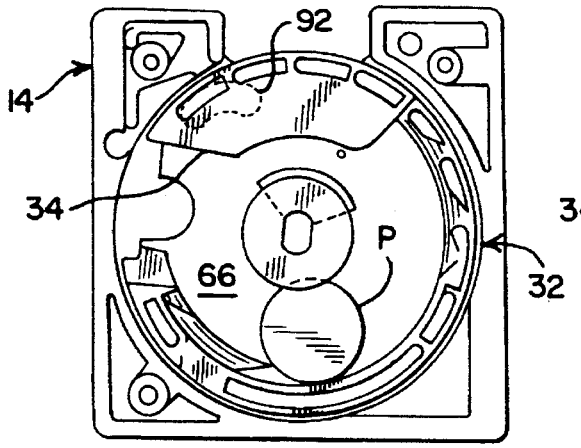

FIG. 8*b* shows the coin wheel rotated further clockwise, specifically to a position at which the slot 34 is approximately 90 degrees clockwise from top center. In this position, the coin P has been moved past the area at which the magnet 92 strongly attracts the coin. Without the attractive force of the magnet, the coin P falls by its own weight along the arcuate coin path 66 in the direction indicated by the arrow 102 in FIG. 8*b*. The coin falls to a lowermost position as shown in FIG. 8*c*.

Figure 8D:
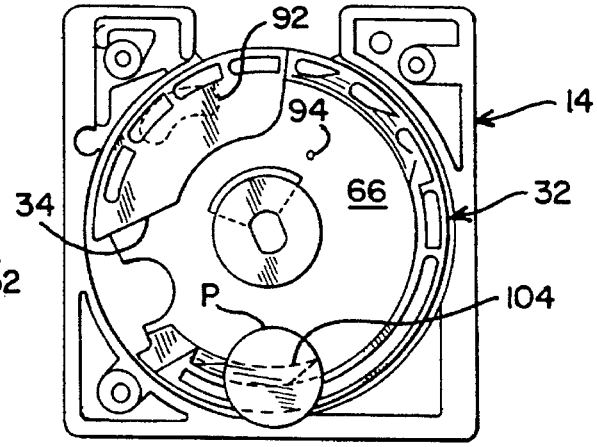

FIG. 8*d* shows the coin wheel advanced further clockwise (approximately 135 degrees past its initial position). By this position, a tapering ridge 104 in the coin path 66 has slid under the coin P and has begun forcing the bottom edge of the coin in a rearward direction (toward the viewer in FIG. 8*d*) so that the coin P is being pushed from the coin wheel into a coin storage bin which is located directed across from the coin receiving mechanism at this lower location. After the coin has been expelled into the coin storage bin, the now empty coin wheel is further rotated back to its original position with the slot 34 oriented upward.

It is noted that the various ways for testing a coin received in the coin slot to determine whether the received coin is a coin of the proper denomination are usually designed to be performed as soon as possible when the coin is received in the coin receiving mechanism. For this reason, the application of the magnetic field to the coin retained in the coin wheel occurs during approximately the first 0–90 degrees of rotation of the coin wheel clockwise from its initial position. In this manner, if a coin of other than the proper denomination is received, it can be expelled from the machine as soon as possible. Actuation of the merchandise dispensing mechanism to dispense bulk items occurs after the coin has passed all the tests for a proper coin included in the coin receiving mechanism. Accordingly, in the example provided above, the gear on the coin receiving mechanism will not actuate the bulk merchandise dispensing mechanism until after the coin wheel has been rotated at least 90 degrees past its initial position.

Now the operation of the coin receiving mechanism will be described when a non-magnetic coin N is inserted into the slot. For purposes of this example, it is assumed that the non-magnetic coin is a U.S. nickel. A U.S. nickel has approximately the same size as a Mexican peso. When a non-magnetic U.S. nickel is inserted into the slot 34, it is retained in the initial position by the retaining pin 94. Accordingly, the U.S. nickel is held in the same initial position as the magnetic Mexican peso coin shown in FIG. 8*a*.

Figure 9A:
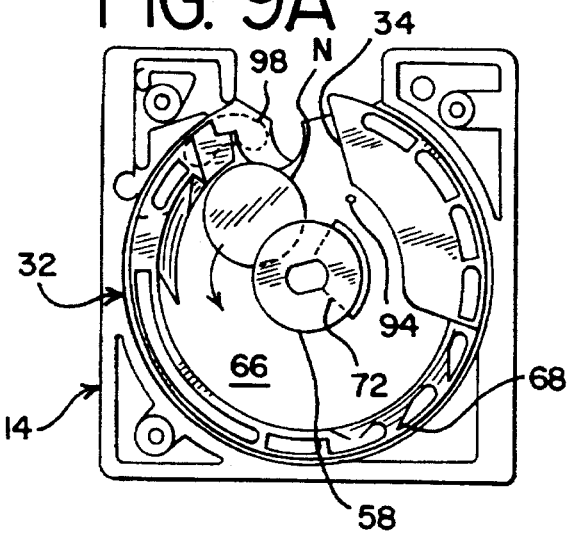
Figure 9B:
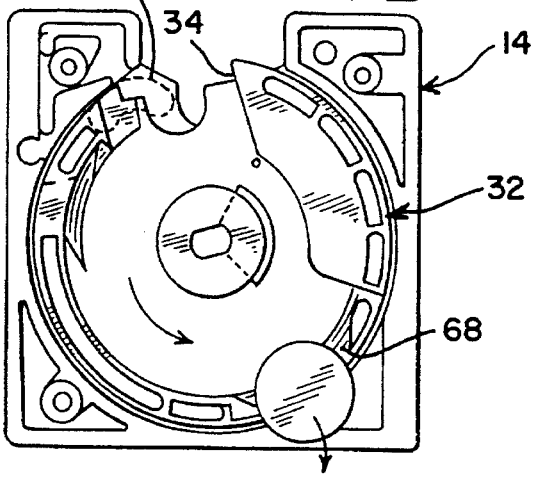

FIGS. 9*a* and 9*b* show what happens when the coin wheel 32 is advanced slightly clockwise with the non-magnetic nickel inserted therein. In FIG. 9*a*, the coin wheel has been advance only about 5–10 degrees. In this position, the non-magnetic coin N has been moved off of the retaining pin 94 and will fall through the coin path 66 passing through the third slot 72 in the raised cylindrical portion 58 as shown in FIG. 9*a*. The coin N rides along the second slot 66 and it will exit through the area 68 as shown in FIG. 9*b*. A recess in the lower edge of the face plate 14 permits the non-magnetic coin N to be expelled out of the bottom of the coin receiving mechanism before it can actuate the merchandise dispensing mechanism.

It is noted that with the exception of the provision for magnetically retaining the coin during the first 90 degrees of rotation, the operation of the coin receiving mechanism of this embodiment is similar to that of prior coin receiving mechanisms such as the coin receiving mechanism disclosed in Ser. No. 07/749,437 now U.S. Pat. No. 5,339,937. As previously mentioned, the coin receiving mechanism may also include the usual features for measuring the coin for assuring the proper size, preventing reverse rotation of the coin wheel, and so on.

Referring to FIGS. 10 through 12, there is depicted another embodiment of the present invention. In the embodiment of FIGS. 10 through 12, there is shown another coin receiving mechanism 120 for a bulk vending machine. This bulk vending machine mechanism 120 is larger in overall size compared to the coin receiving mechanism depicted in FIGS. 1–9 and is designed for use in a different style of bulk vending machine. However, apart from size, the coin receiving mechanism shown in FIGS. 10 through 12 is similar to that of the previously described embodiment.

The coin receiving mechanism 120 has a front plate 122 through which extends a handle 124 that is connected to a coin wheel 126. A coin receiving slot 128 is defined by the face plate 122 and aligns with a coin receiving slot 130 in the coin wheel 126. A frame 132 is mounted behind the face plate 122 with the coin wheel 126 between the frame 132 and the face plate 122 similar to the previous embodiment. A retaining pin 133 is mounted on the non-rotating frame 132 extending in a direction toward the rotating coin wheel 126. The retaining pin 13 is located to hold a coin of the proper size in the initial position of the coin wheel, i.e. with the slot 130 oriented upward.

As in the previous embodiment, a magnet 140 is located in an upper right hand portion 142 of the frame 132 so that the magnetic field produced by the magnet exerts an attractive force on a coin retained in the coin wheel slot 130 as it moves immediately clockwise from its initial position. Just as in the previous embodiment, the attractive force exerted by the magnet 140 on the coin will retain the coin in the coin wheel as it is rotated clockwise for approximately 90 degrees if the coin is magnetic. If the coin is non-magnetic, the magnetic field will not affect the coin and as a consequence the coin will fall by its own weight downward along the coin path 144 in the coin wheel where it will be expelled through slot 146.

Because the coin wheel 126 of this embodiment is larger than the coin wheel of the previous embodiment, it is not required that the stem 150 have a laterally oriented cut-out portion in order to provide sufficient room for the rejected coin to be expelled along the coin path 144. In all other respects, this embodiment is similar in operation to the embodiment described above.

It is intended that the foregoing detailed description be regarded as illustrative rather than limiting and that it is understood that the following claims including all equivalents are intended to define the scope of the invention.

I claim:

1. A bulk vending machine comprising:

a vending machine housing having a storage bin for storing bulk items a dispensing mechanism operatively associated with the storage bin for dispensing a quantity of bulk items from said storage bin;

a coin receiving mechanism mounted in said housing and operatively connected to said dispensing mechanism, said coin receiving mechanism comprising;

a frame;

a rotatable coin wheel rotatably mounted to said frame, said rotatable coin wheel having a coin reception slot into which a coin of proper denomination can be received;

a coin storage area;

a coin rejection slot aligned with respect to said coin reception slot so that a coin received in said coin reception slot is expelled from said coin receiving mechanism through said coin rejection slot; and a magnet mounted adjacent to said coin wheel and operatively adapted to apply a magnetic field to retain a magnetic coin in said coin receiving mechanism so that said magnetic coin can be directed into said coin storage area, wherein said magnet is located with respect to said coin wheel so as to apply-said magnetic field to a coin retained in said coin reception slot after said coin is rotated past an initial reception position by said coin wheel.

2. The bulk vending machine of claim 1 in which said magnet is a permanent magnet.

3. The bulk vending machine of claim 1 in which said coin receiving mechanism includes a locking mechanism to prevent rotation of said coin wheel from an initial position when a coin is absent from said coin reception slot.

4. A bulk vending machine comprising:

a vending machine housing having a storage bin for storing bulk items, a dispensing mechanism operatively associated with the storage bin for dispensing a quantity of bulk items from said storage bin;

a coin receiving mechanism mounted in said housing and operatively connected to said dispensing mechanism, said coin receiving mechanism comprising:

a frame;

a rotatable coin wheel rotatably mounted to said frame, said rotatable coin wheel having a coin reception slot into which a coin of proper denomination can be received;

a coin storage area;

a coin rejection slot aligned with respect to said coin reception slot so that a coin received in said coin reception slot is expelled from said coin receiving mechanism through said coin rejection slot;

a magnet mounted adjacent to said coin wheel and operatively adapted to apply a magnetic field to retain a magnetic coin in said coin receiving mechanism so that said magnetic coin can be directed into said coin storage area; and a retainer located on a non-rotating portion of said coin receiving mechanism and relative to an initial position of the coin wheel so that when said coin wheel is in an initial position, said retainer supports a coin in said coin reception slot.

5. In a vending machine having a housing and a dispensing mechanism operatively associated with a storage bin for dispensing a quantity of bulk items from said storage bin, an improved coin receiving mechanism mounted in said housing and operatively connected to the dispensing mechanism, said coin receiving mechanism comprising:

a frame;

a coin reception slot defined at least in part by said frame and into which a coin of proper denomination can be received;

a coin storage compartment;

a coin rejection path defined at least in part by said frame and aligned with respect to said coin reception slot so that a coin received in said coin reception slot is expelled from said coin receiving mechanism through a coin rejection slot;

a magnet mounted in proximity to said coin rejection path and operatively adapted to apply a magnetic field to prevent a magnetic coin from being expelled from said coin rejection slot; and a retainer pin mounted with respect to said coin reception slot as to temporarily retain a coin received in said slot.

6. The invention of claim 5 in which said retainer pin is mounted on said frame.

7. The invention of claim 5 further comprising:

a coin wheel rotatable mounted with respect to said frame, said coin wheel also defining in part said coin reception slot and said coin rejection path.

8. The invention of claim 7 in which said magnet is located with respect to said coin wheel so that the magnetic field of said magnet is applied to said coin wheel along a portion thereof adjacent to an initial position of said coin wheel.

9. The invention of claim 5 in which said frame is non-rotatable.

10. The invention of claim 5 in which said frame comprises:

a face plate; and a rear frame member.

11. A method of operating a coin receiving mechanism in a bulk vending machine comprising the steps of:

receiving a coin in an initial position in a slot of the coin receiving mechanism;

supporting the coin in the initial position;

moving the coin from the initial position to a second position at which the coin is unsupported;

applying a magnetic force toward in the coin in the second position;

expelling a coin from the slot if the coin is not retained by the magnetic force; and accepting the coin for permitting dispensing of products if the coin is retained by the magnetic force in the second position.

12. The method of claim 11 in which said coin is moved from said initial position by a coin wheel.

13. The method of claim 12 in which said coin is moved from said initial position along a circular path.

14. The method of claim 11 further comprising:

expelling a coin from the coin receiving mechanism if the coin is not retained by the magnetic force.

15. The method of claim 14 in which the coin is expelled from the coin receiving mechanism along a second coin path.

16. The method of claim 11 further comprising the step of:

dispensing merchandise from the bulk vending machine.

17. The method of claim 16 in which said coin is moved from said initial position by a coin wheel.

18. The method of claim 17 further in which the merchandise is dispensed from the bulk vending machine after the coin wheel has been rotated at least 90 degrees.

* * * * *

UNITED STATES PATENT AND TRADEMARK OFFICE

CERTIFICATE OF CORRECTION

PATENT NO. : 5,509,521
DATED : April 23, 1996
INVENTOR(S) : Richard K. Bolen

It is certified that error appears in the above-indentified patent and that said Letters Patent is hereby corrected as shown below:

COLUMN 9:

In claim 1, line 3, after "items" insert --,--.

In claim 1, line 8, delete ";" and substitute --:--.

In claim 1, line 24, delete "apply-said" and substitute --apply said--.

COLUMN 10:

In claim 5, line 22, after the first occurrence of "slot" insert --so--.

Signed and Sealed this

Eighteenth Day of February, 1997

*Attest:*

Bruce Lehman

BRUCE LEHMAN

*Attesting Officer*

*Commissioner of Patents and Trademarks*